US005249703A

United States Patent [19]

Karp

[11] Patent Number: 5,249,703

[45] Date of Patent: Oct. 5, 1993

[54] TRAVEL MUG

[76] Inventor: Morry Karp, 2189 Summitridge Dr., Beverly Hills, Calif. 90210

[21] Appl. No.: 37,917

[22] Filed: Mar. 26, 1993

[51] Int. Cl.[5] ..... B65D 41/06; B65D 41/26

[52] U.S. Cl. ..... 220/719; 220/715; 220/713; 220/293; 220/298

[58] Field of Search ..... 222/548, 562, 563; 220/711, 713, 714, 715, 717, 719, 293, 297, 298, 303; 215/302, 296

[56] References Cited

U.S. PATENT DOCUMENTS

| | | | |
|---|---|---|---|
| 634,742 | 10/1899 | Bayless | 215/302 |
| 2,858,041 | 10/1958 | Robinson | 215/10 |
| 4,582,218 | 4/1986 | Ross | 220/711 |
| 5,018,636 | 5/1991 | Ross | 220/719 |
| 5,102,000 | 4/1992 | Feltman, III | 220/293 |

*Primary Examiner*—Allan N. Shoap
*Assistant Examiner*—S. Castellano
*Attorney, Agent, or Firm*—Marvin H. Kleinberg

[57] ABSTRACT

A travel mug includes a container and a lid in combination. The container has a handle and an annular lip. The lid has an annulus capable of forming a seal with the top side of the annular lip. A cylindrical well in the lid has a vertical dividing wall so that the lid may be readily rotated by hand. Two retaining arms extend from the underside of the lid and engage the underside of the annular lip to pull it into tight abutment therewith. Diametrically opposed gaps in the lip act as passageways for the retaining arms. Diametrically opposed notches in the lid when aligned with the gaps allow a person to drink from the otherwise sealed container.

4 Claims, 2 Drawing Sheets

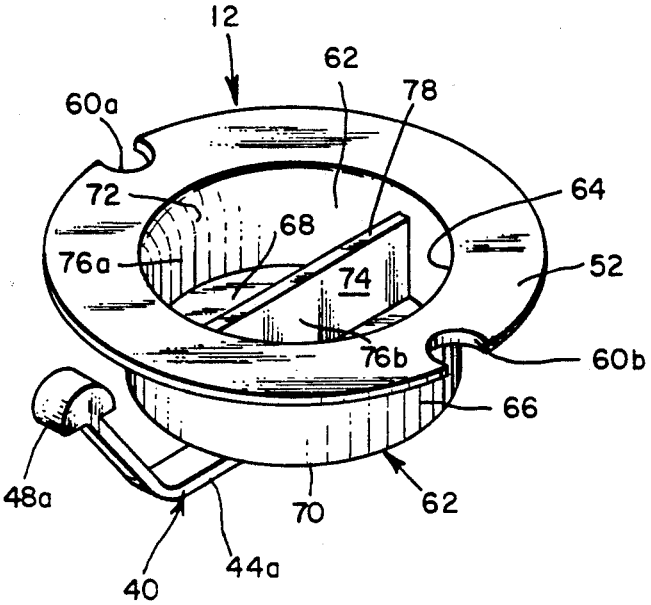
Fig. 3.
Fig. 4.
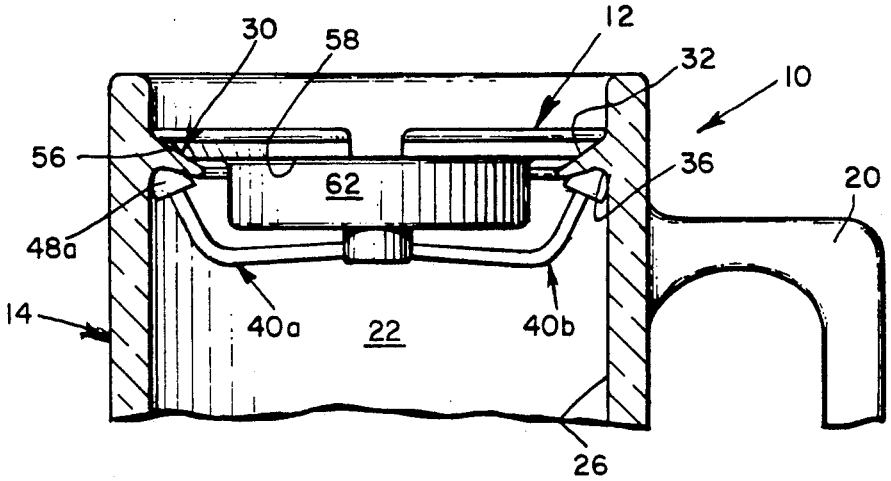
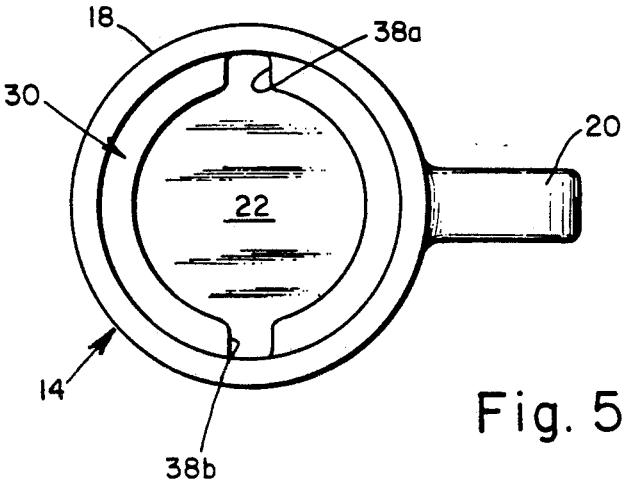
Fig. 5.

TRAVEL MUG

BACKGROUND

The present invention relates to containers for liquids, and more particularly, a travel mug, which reduces the rate of liquid temperature change, prevents the liquid from spilling when jolted, and allows a person to drink from an otherwise closed container.

Containers for liquids having the foregoing properties exist. However, these containers, such as insulated bottles with screw-on covers, typically have no means for unencumbered access to drinking the liquid contained therein. Other such containers may have means for opening the container to drink from it and closing the container to prevent spillage while not being so used, but are generally cumbersome and not convenient to use, especially in a moving vehicle. The jar disclosed in U.S. Pat. No. 634,742 is typical and teaches a lid which through rotation seals the jar but which requires a special tool for removal of the lid.

Still other containers have addressed the foregoing concerns by using container lids that allow ready access for drinking purposes and reduce the liquid's rate of temperature change, but such lids also allow the liquid to splash out of the container when this is not desired. Typical prior art containers are disclosed in U.S. Pat. Nos. 4,582,218; 5,018,636; and 5,102,000. The narrow band of lid sealing area such as is shown in U.S. Pat. No. 5,018,636, for example, contributes to such splashing.

Some lids have a well that retains liquid that has splashed to the top. These wells are typically divided by a vertical wall which acts as a handle for turning the lid. However, when liquid resides in the well and the drinker tips the container upward to drink, the liquid can spill unpredictably over the handle. One such lid is shown in U.S. Pat. No. 4,582,218.

Yet other lids, such as snap-on type lids, can squirt a stream of liquid on the drinker when the container is filled too full and the lid is then snapped in place on the container.

The cup disclosed in U.S. Pat. No. 2,858,041 has an interrupted recessed annular baffle ring of triangular shape to deter splashing, but the top of the container is otherwise open so that it has negligible ability to reduce the liquid's rate of temperature change.

The lids of the cups disclosed in U.S. Pat. Nos. 5,102,000 and 5,018,636 have only one opening for drinking purposes. Accordingly, while they may be utilized for either right or left handed users, a separate vent to atmosphere is not provided. The lack of such a vent adversely affects the flow of fluid out of the gap because ambient air cannot be readily introduced to replace withdrawn fluid. The lid of the combination shown in U. S. Pat. No. 4,582,218 does have diametrically opposed gaps, but requires an expensively configured cup of unusual design.

For the foregoing reasons, there is a need for a beverage container that reduces temperature changes of the liquid therein, provides improved control of the liquid while in use for drinking and while being jolted, and yet allows a user to readily drink the liquid contained therein.

SUMMARY

According to the present invention, a travel mug includes a container which has on its inner wall an annular lip which extends radially into the container such as shown in U.S. Pat. No. 2,858,041. The annular lip is sloped slightly downward and has an underside which forms a concave annular cavity with the container's inner wall. Two gaps are provided in the annular lip and are diametrically opposed.

A special lid somewhat comparable to that shown in U.S. Pat. No. 4,582,218 is provided to control the flow of liquid and to control the temperature of the contents by reducing heat loss through radiation. The lid of the present invention has an annulus and a cylindrical well attached to the annulus. The annulus has a horizontal top surface and an outer edge. The annulus also has a taper to the outer edge. The outer edge includes a pair of diametrically opposed cutouts or notches. The tapered surface allows for improved seating and sealing of the lid on the annular lip of the container. The cylindrical well has a substantially flat base.

With the lid in place and rotated so that the gaps in the annular lip and the notches in the annulus do not coincide, any beverage in the container is unlikely to splash out through non-inverting motion of the container.

The base of the lid has two retaining arms which, in the preferred embodiment, are fastened at the center of the base. These retaining arms may have a spring force which urges a contact nodule at the retaining arm's free end into tighter engagement with the annular lip when in place. A vertical dividing wall creates two half-cylindrical wells within the cylindrical well and a means for rotating the lid, relative to the container. Unlike U.S. Pat. No. 4,582,218, the lid's vertical dividing wall in the present invention has means for allowing liquid to flow between the two half-cylindrical wells.

The retaining arms are positioned to pass through the gaps in the lip. When the lid is then rotated, the contact nodules engage the underside of the lip and press, under the spring force, against the inner wall of the container so as to retain the lid in tight abutment between the tapered edge of the annulus and the annular lip, tending to prevent fluid leakage.

DRAWINGS

These and other features, aspects, and advantages of the present invention will become better understood with regard to the following description, appended claims, and accompanying drawings where:

FIG. 3 shows a magnified perspective of the lid;

FIG. 4 shows a cross-sectional view of the annular lip with the lid in place;

FIG. 5 shows a top view of the container without the lid.

DESCRIPTION

The present invention is directed to a travel mug that reduces the rate of liquid temperature change, prevents the liquid from spilling when the container is jolted and allows a person to drink from an otherwise closed container.

Figure 1:
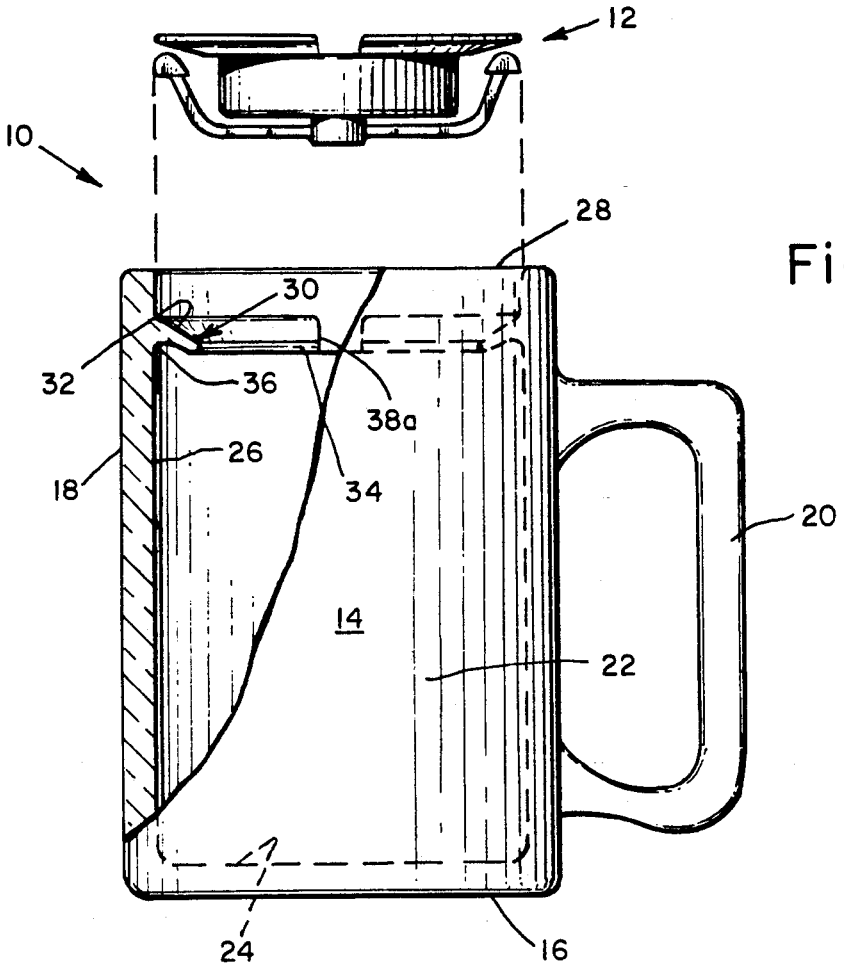
FIG. 1 shows a side view of the container and lid.

A side view of the travel mug 10 is shown in FIG. 1. The travel mug comprises a lid 12 and a container 14. An outer base 16 provides support for the mug and cooperates with an outer wall 18. A handle 20 is attached to the outer wall. An internal chamber 22 is formed by the container's inner base 24 and inner wall 26.

Recessed from the upper edge 28 of the mug 10 is an annular lip 30 which extends from the inner wall 26. The annular lip 30 is sloped slightly downward. The annular lip 30 has a top side 32, an underside 34, a concave annular cavity 36, a first gap 38*a*, and a second gap 38*b*. The concave annular cavity 36 is formed so as to redirect any beverage that splashes up the inner wall 26 back into the internal chamber 22. The annular lip 30 has a relatively thin, substantially constant cross section although there may be a slight taper to the innermost edge.

The container can be constructed from glass, ceramic, plastic or any other non-porous material.

Figure 2:
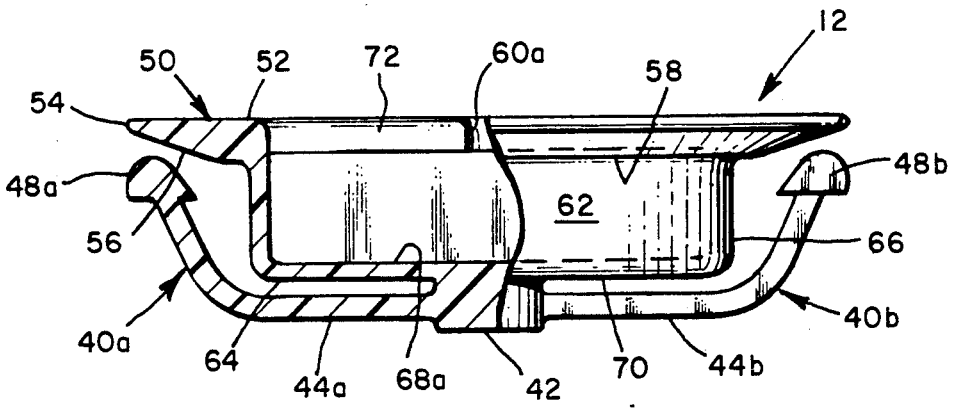
FIG. 2 shows a magnified cross-section of the lid.

A magnified cross-sectional view of the lid 12 is shown in FIG. 2. The lid comprises a first retaining arm 40*a* and a second retaining arm 40*b* each fastened at a common mounting block 42, The retaining arms 40*a,b* further comprise a first horizontal arm 44*a*, a second horizontal arm 44*b*, a first angled arm 46*a*, a second angled arm 46*b*, a first contact nodule 48*a*, and a second contact nodule 48*b*. The lid 12 also comprises an annulus 50 having a horizontal top surface 52, an outer edge 54, a tapered lower surface 56, and a horizontal lower surface 58. As shown in FIG. 3, the outer edge 54 has a first notch 60*a* and a second notch 60*b* each of which is approximately equidistant from an imaginary line passing through the first contact nodule 48*a* and the second contact nodule 48*b*.

The taper of the lower surface 56 allows a better seal between the lid 12 and the annular lip 30 than could otherwise be achieved. When liquid in the internal chamber 22 splashes upward, the horizontal lower surface 58 acts to redirect the splashing liquid back into the internal chamber 22. Since liquid can flow equally well out of either notch 60*a* or 60*b* when the container is tipped up for drinking purposes, the notches 60*a,b* allow equal ease of use regardless of the drinker's handedness.

Also, while one notch 60*a* allows the liquid to flow into the drinker's mouth, the other notch 60*b* acts as a passageway for equalizing the pressure between the atmosphere and the internal chamber where the liquid resides. This allows the internal chamber 29 to remain at substantially atmospheric pressure thereby providing for a predictable and unrestrained flow of the liquid into the drinker's mouth.

The lid 12 further comprises a cylindrical well 62 shown in FIG. 3. The cylindrical well 62 is formed by an inner vertical surface 64, an outer vertical surface 66, an inner horizontal surface 68, an outer horizontal surface 70, and a top opening 72 as shown in FIG. 2. The cylindrical well's outer vertical surface 66 provides additional sealing between the lid 12 and the annular lip 30. When liquid in the internal chamber 22 splashes upward, the cylindrical well's outer horizontal surface 70 acts to redirect the splashing liquid back into the internal chamber 22.

The lid 12 also comprises a vertical dividing wall 74 extending across the diameter of the cylindrical well 62 in a direction substantially parallel to the retaining arms 40*a,b*. The vertical dividing wall 74 thus divides the cylindrical well 62 into a first half-cylindrical well 76*a* and a second half-cylindrical well 76*b* as shown in FIG. 3. The height of the vertical dividing wall 74 is such that its top edge 78 is below the horizontal top surface 52 of the lid's annulus 50.

The vertical dividing wall 74 also serves as a handle for allowing the user to apply and remove the lid 12 by rotating it relative to the container. Because the vertical dividing wall 74 resides in a cylindrical well 62, the drinker can apply a greater moment to the lid 12 for the purpose of rotating the lid than would be the case if the well were hemispherical. This greater moment allows greater ease of rotating the lid.

In order to remove or install the lid 12, the lid 12 is rotated to align the contact nodules 48*a,b* with the gaps 48*a,b* in the annular lip 30. The retaining arms 40*a,b* and contact nodules 48*a,b* are oriented such that the contact nodules 48*a,b* press against the inner wall 26 of the container 14 and the concave annular cavity 36. This pressure enables the lid to form a tight seal with the annular lip 30 and remain securely in place until the user rotates the lid.

When the lid 12 is installed and the notches 60*a,b* are aligned with the gaps 38*a,b* , the openings resulting therefrom allow beverage to escape from one opening while the other opening allows the internal chamber 22 to remain at substantially atmospheric pressure. When the lid 12 is installed and the notches 60*a,b* are not aligned with the gaps 38*a,b*, a seal is formed to prevent any liquid in the internal chamber 22 from escaping, even when the travel mug is jolted. In the event liquid reaches the cylindrical well 62, the vertical dividing wall's 74 reduced height allows the liquid to remain within the cylindrical well while it trickles over the vertical dividing wall's top edge 78 and into the drinker's mouth when the container's outer base 16 is turned upward for drinking purposes. If the vertical dividing wall's top edge 78 were the same height as the horizontal top surface 52, liquid in the cylindrical well 62 could flow unpredictably to the outer edge of the lid 12 when the container 14 is tipped upward for drinking purposes.

Although the present invention has been described in considerable detail with reference to a preferred version thereof, other versions are possible. For example, the angled arms 46*a,b* could be vertically oriented, the contact nodules 48*a,b* could be hemispherical in shape, the top side 32 of the annular lip 30 could have a horizontal orientation or the vertical dividing wall 74 could have an opening where it mates with the cylindrical well's inner horizontal surface 68 to allow the free flow of liquid from one half of the cylindrical well 62 to the other. Alternatively, the annular lip 30, the lid 12, or both, could incorporate a material having appropriate deformation properties to compensate for such sealing irregularities. Additionally, the container 14, the lid 12, or both, could have double-wall construction to provide additional insulation of the liquid. Therefore, the spirit and scope of the appended claims should not be limited to the description of the preferred versions contained therein.

What is claimed is as new is:

1. A travel mug comprising in combination:

a. a container having a base and continuous side wall to form an internal chamber;

b. a handle attached to the exterior of said side wall;

c. a relatively thin annular lip extending from the interior of said side wall, said lip having an underside, a concave annular cavity on said underside, and an upper side;

d. two diametrically opposed gaps in said annular lip located approximately 90 degrees from a point on the annular lip nearest to said handle;

e. a lid member having an annulus, said lid annulus having a horizontal top surface, an outer edge, and a lower surface portion extending inwardly from said edge;

f. a well in said lid member surrounded by said annulus, said well having inner and outer vertical surfaces and inner and outer horizontal surfaces forming an opening in said top surface of said annulus;

g. first and second notches in said annulus' outer edge;

h. first and second retaining arms fastened to said well's outer horizontal surface;

i. a vertical dividing wall spanning the diameter of said well, thereby creating two half-cylindrical wells; and j. means in said well for permitting fluid flow between said half-cylindrical wells, whereby said retaining arms are passed through said gaps in said lip and are adapted to bear against said concave annular cavity for thereby sealing said internal chamber and for allowing fluid within to escape said container only through said gaps.

2. The travel mug of claim 1 wherein said retaining arms each have a contact nodule for engaging said annular lip underside.

3. A travel mug comprising in combination:

a. a container having a base and continuous side wall to form an internal chamber;

b. a handle attached to the exterior of said side wall;

c. an annular lip extending from the interior of said side wall, said lip having an underside, a concave annular cavity on said underside of said lip and an upper side;

d. two diametrically opposed gaps in said annular lip, each located approximately 90 degrees from a point nearest to said handle;

e. a lid member having an annulus;

f. a cylindrical well attached to said lid member annulus, said well having inner and outer vertical surfaces and inner and outer horizontal surfaces, said well forming an opening in an annulus top portion, said annulus further comprising a horizontal top surface, an outer edge, a tapered lower surface portion extending inwardly from said outer edge and a horizontal lower surface portion to said well;

g. first and second notches in said annulus outer edge;

h. first and second retaining arms fastened to said well outer horizontal surface, i. a vertical dividing wall spanning the diameter of said well, thereby creating two half-cylindrical wells; and j. means in said well for permitting fluid flow between said half-cylindrical wells, whereby said retaining arms are passed through said gaps in said lip and are adapted to bear against said concave annular cavity for thereby sealing said internal chamber and for allowing fluid within to escape said container only through said gaps.

4. The invention defined in claim 3 wherein said retaining arms each have a contact nodule whereby said contact nodules press against said concave annular cavity.

* * * * *